US006179288B1

(12) United States Patent
Bezelga et al.

(10) Patent No.: US 6,179,288 B1
(45) Date of Patent: Jan. 30, 2001

(54) ENVELOPE REORIENTATION DEVICE

(75) Inventors: Christophe Bezelga, Sceaux; Michel Joson, Fontenay Tresigny; Frédéric Trescazes, Paris, all of (FR)

(73) Assignee: Neopost Industrie, Bagneux (FR)

( * ) Notice: Under 35 U.S.C. 154(b), the term of this patent shall be extended for 0 days.

(21) Appl. No.: 09/159,084

(22) Filed: Sep. 23, 1998

(30) Foreign Application Priority Data

Sep. 23, 1997 (FR) ..... 97 11797

(51) Int. Cl.[7] ..... B65H 5/00; B65H 7/02; B65H 29/00

(52) U.S. Cl. ..... 271/225; 271/184; 271/185; 271/227

(58) Field of Search ..... 271/184, 185, 271/225, 227

(56) References Cited

U.S. PATENT DOCUMENTS 3,779,546 * 12/1973 Wojtowicz et al. ..... 271/196
4,648,503 * 3/1987 Stemmler et al. ..... 198/410
4,724,945 * 2/1988 Martin ..... 198/412
4,756,521 * 7/1988 Martin ..... 271/225
4,928,807 * 5/1990 Auerbach ..... 198/379
5,104,470 4/1992 Ritchie .
5,152,122 10/1992 DeBarber et al. .
5,154,405 * 10/1992 Graveson et al. ..... 271/2
5,236,072 * 8/1993 Cargill ..... 194/207
5,290,027 * 3/1994 Clanton et al. ..... 271/227
5,320,340 * 6/1994 Bay ..... 271/225
5,466,079 * 11/1995 Quintana ..... 400/579
5,535,999 * 7/1996 Ford ..... 271/185
5,564,848 * 10/1996 Quintana ..... 400/708
5,887,996 * 3/1999 Castelli et al. ..... 400/579

* cited by examiner

*Primary Examiner*—Donald P. Walsh
*Assistant Examiner*—Brett A Martin
(74) *Attorney, Agent, or Firm*—Sughrue, Mion, Zinn, Macpeak & Seas, PLLC

(57) ABSTRACT

A feed device for feeding a document folding and/or inserting machine with envelopes delivered by a general-purpose printer, said feed device comprising detection means for detecting the position of the envelope at the outlet of the printer and reorientation means for reorienting the envelope as a function of its position as determined by said detection means so as to enable documents to be inserted into the envelope. The detection means advantageously comprise a detector for detecting an edge of the envelope, and the reorientation means advantageously comprise a turntable.

12 Claims, 2 Drawing Sheets

ENVELOPE REORIENTATION DEVICE

TECHNICAL FIELD

The present invention relates to a document folder/inserter, in particular in the field of handling and conveying mail. More particularly, it relates to a device enabling envelopes to be fed automatically from a general-purpose printer.

PRIOR ART

French Patent No. 93 15909 filed in the Applicant's name discloses a device for automatically feeding documents, which device is designed to be mounted on a document folding and/or inserting machine and offering a plurality of operating modes, thereby making the machine very flexible to use. Above the document inlet of that machine, there are at least two document loading trays suitable for co-operating with said inlet as a function of various operating modes: namely either individually or in combination with each other, by means of detectors and propulsion members controlled by a microprocessor of the general control circuit of the machine. The empty envelopes are fed in by means of an envelope loading tray preferably disposed at the back of the machine.

With the Patent Application entitled "Système de préparation d'articles de courrier" ("A system for preparing mail items"), filed jointly with the present Application, the Applicant discloses a novel type of mail preparation machine that is entirely self-contained, and that makes use in particular of a general-purpose printer that feeds a document folding and/or inserting module directly.

Unfortunately such a direct link between the folding and/or inserting module and the general-purpose printer poses the new problem of transferring the envelope between those two elements, since current inserting modules (operating with an automatic empty-envelope loading tray only) are totally unsuited to co-operating with a general-purpose printer which delivers the envelopes directly.

Conventionally, general-purpose printers of the laser type or of the ink jet type are not specially designed to deliver envelopes, rather they are designed to deliver documents, in general A4-format documents. As a result, when they print envelopes, the envelopes delivered can be oriented in various ways depending on the type of printer used or depending on the printer manufacturer. For example, some printers deliver the envelopes lengthwise with them being aligned or "jogged" on the right edge. But in certain other models of printer, alignment is performed on the left or else is centered. Envelopes can also be delivered widthwise. Such a wide variety of output configurations is further complicated by the fact that the dimensions of the envelopes suffer from a lack of standardization (for example, the standard American #10 format (105 mm×241 mm) is different from the standard French C5/6 format (114 mm×229 mm).

OBJECTS AND DEFINITION OF THE INVENTION

An object of the present invention is to remedy those drawbacks by providing a feed device that is specially adapted to enable a folding and/or inserting machine (or module) to be fed with empty envelopes directly from a general-purpose printer. An object of the invention is to provide a device that is matches the various printer models on the market. Another object is to provide a device that is suitable for the various envelope formats that exist.

These objects are achieved by a feed device for feeding a document folding and/or inserting machine with envelopes delivered by a general-purpose printer, said feed device comprising detection means for detecting the position of the envelope at the outlet of the printer and reorientation means for reorienting the envelope as a function of its position as determined by said detection means so as to enable documents to be inserted into the envelope.

By means of this particular architecture, the envelope can be conveyed to the envelope path of the folder/inserter where it is presented in an optimum position for insertion purposes. The type of printer and the format of the envelopes are no longer important, and a folder/inserter equipped with this device becomes truly universal.

Advantageously, the detection means comprise a detector for detecting an edge of the envelope. They may further comprise means for determining the orientation of the envelope.

Preferably, the reorientation means comprise a turntable which, by rotating within a plane, makes it possible to displace the envelope from a first position corresponding to its position at the outlet of the printer to a second position enabling documents to be inserted into it. The reorientation means further comprise a counter-turntable against which the turntable can be displaced by means of second drive means, so as to hold the envelope stationary by clamping it so that it can be rotated. The turntable is rotated by first drive means under the action of control means.

The feed device of the invention further comprises first propulsion means for propelling the envelope from an inlet of the device to the reorientation means, and second propulsion means for propelling the reoriented envelope to an outlet of the device. The propulsion means are actuated as a function of the position of the envelope as determined by the detection means. The detection means further comprise means for delivering the format of the envelope.

Advantageously, the first and second propulsion means are constituted by at least two parallel assemblies of propulsion rollers controlled by third drive means common to the two propulsion means and acting against associated counter-rollers. The number and positions of the propulsion rollers are determined such as to enable envelopes of all formats and of all orientations to be propelled.

The invention also provides a document folding and/or inserting machine equipped with such an envelope feed device.

BRIEF DESCRIPTION OF THE DRAWINGS

Other characteristics and advantages of the present invention appear more clearly from the following description given by way of non-limiting example and with reference to the accompanying drawings, in which.

DETAILED DESCRIPTION OF A PREFERRED EMBODIMENT

It is known that a folding and/or inserting machine serves to put mail, such as documents, advertising leaflets, or reply envelopes, into envelopes, preferably as the mail is being produced. Such a machine is part of the equipment of a secretarial workstation where it constitutes one of the machines available to a person working at said workstation.

The machine merely stands on the work surface of the workstation and access to it is easy, in particular for feeding in mail which is to be put into envelopes by said person.

Figure 1:
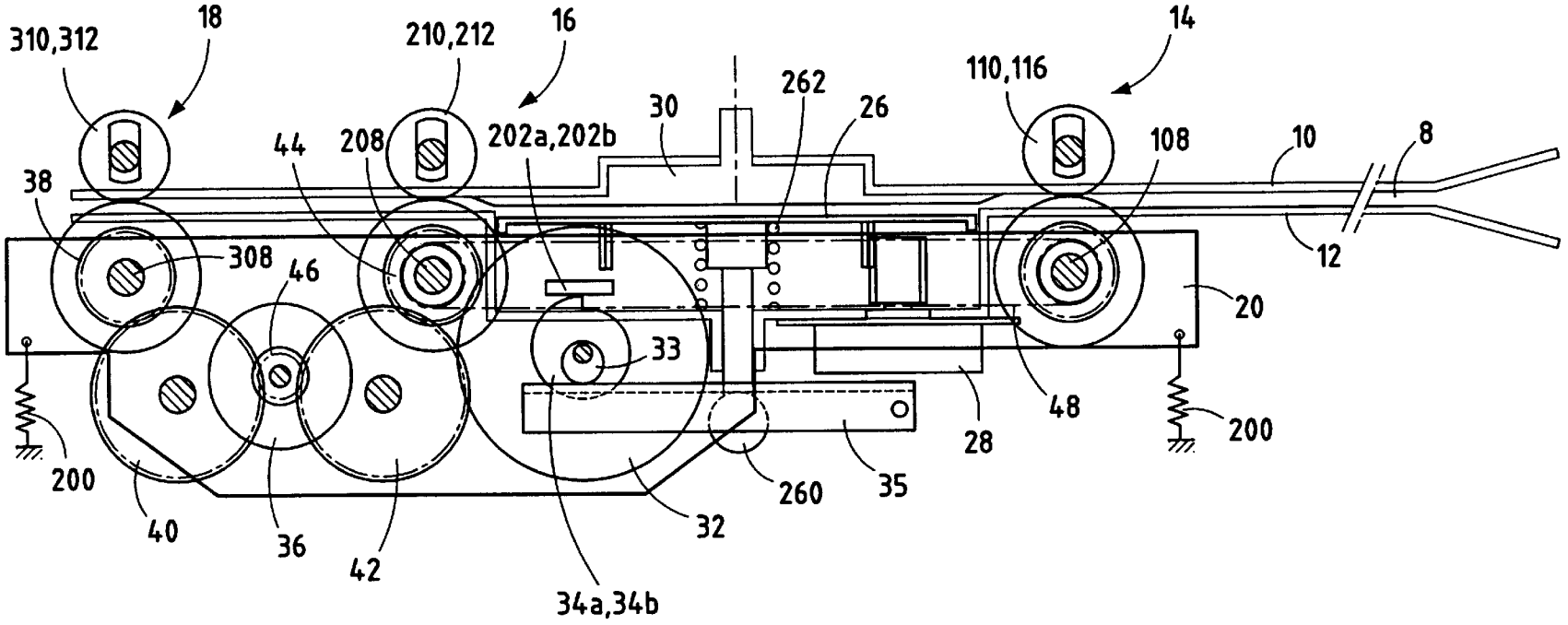
FIG. 1 is a side view of an envelope feed device of the invention.
Figure 2B:
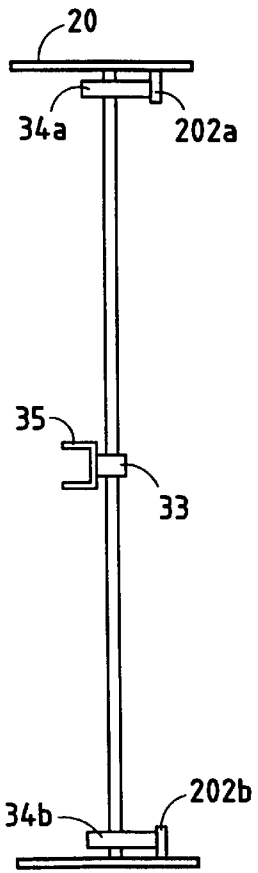
FIG. 2*b* is a section view on the plane II—II of FIG. 2*a*.
Figure 2A:
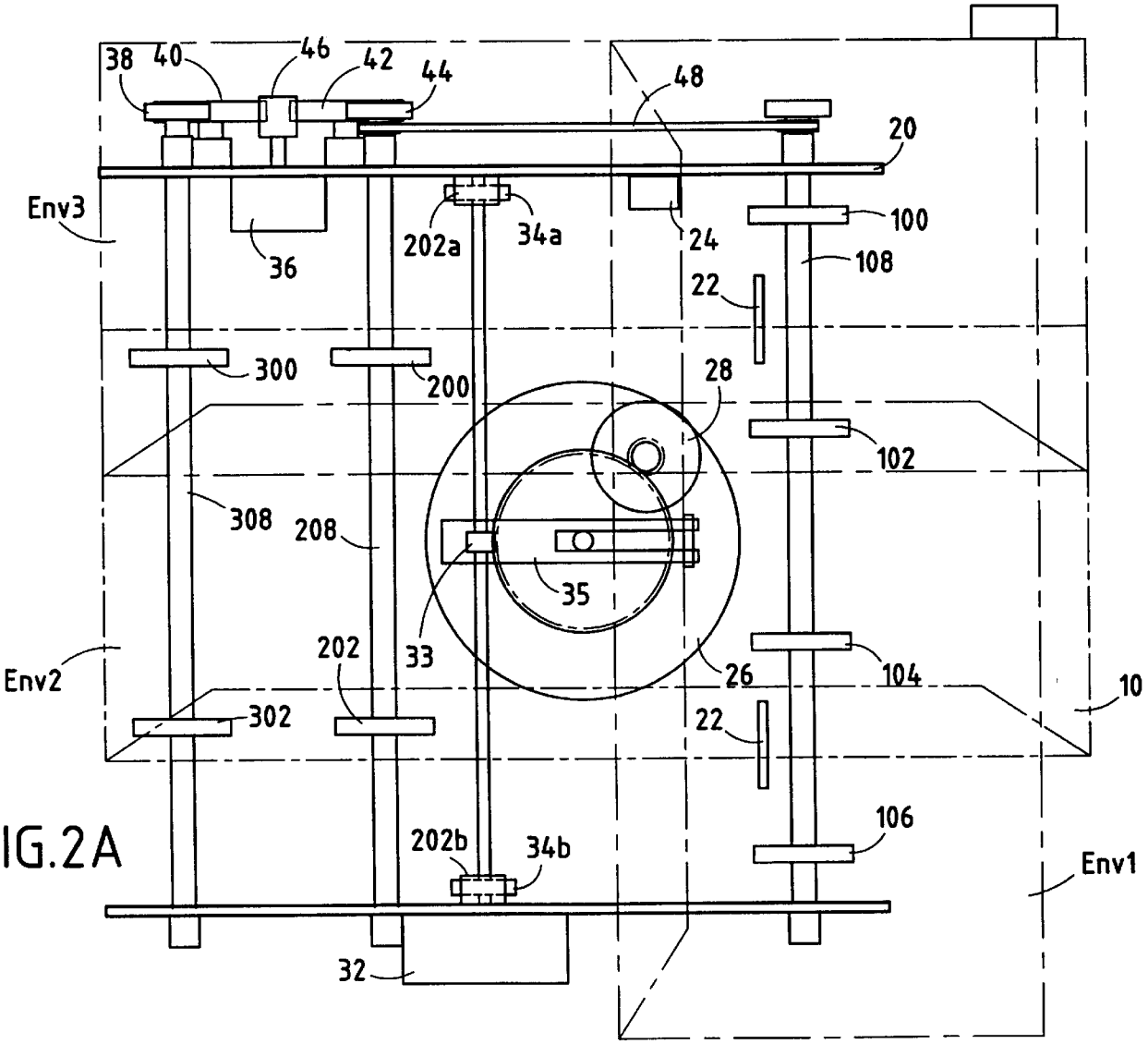
FIG. 2*a* is a plan view of the device shown in FIG. 1.

Reference is made to FIGS. 1, 2*a*, and 2*b* which are different views of an envelope feed device of the invention which is designed preferably to be integrated into a folding and/or inserting machine (not shown) or optionally to form a stand-alone module that can be disposed upstream from a traditional folding and/or inserting machine, replacing its empty-envelope loading tray.

The device is provided with an envelope-receiving chute 8 forming the conveyor path for the envelopes and disposed between a first stationary guide plate 10 serving as a top reference surface for the envelopes and a second stationary guide plate 12 serving as a bottom reference surface for the envelopes. The chute is designed to convey the envelopes one-by-one in a displacement direction D from an inlet of the device (which is connected directly to the outlet of a general-purpose printer) to an outlet of the device (which is connected directly to the inserting module of the machine or to its empty-envelope inlet depending on whether the device is internal or external). A synchronized propulsion system for conveying the envelopes through the device is disposed under the second stationary guide plate and passing through it in places. In planes parallel to the displacement direction D, the propulsion system comprises at least two propulsion assemblies 14, 16, 18 mounted on a carriage 20 mounted to move vertically, each assembly being formed of a assembly of propulsion rollers 100, 102, 104, 106; 200, 202; 300, 302 carried by a motor-driven common shaft 108; 208; 308 and of associated idler counter-rollers 110, 112, 114, 116; 210, 212; 310, 312.

The number of the roller/counter-roller pairs is at least two per propulsion assembly 14, 16, 18, and preferably four per propulsion assembly. They are distributed on the common shaft in a manner such that the envelope is always engaged in the device regardless of its format or of its orientation at the outlet of the printer. The envelope can be delivered by the printer either lengthwise or widthwise, and it can be centered or otherwise: i.e. it can be aligned or "jogged" on the right or on the left; with its flap itself being positioned either on the right or on the left. FIG. 2 shows three different envelope orientations in dashed lines: namely widthwise delivery (Env1), centered lengthwise delivery (Env2), and right-aligned lengthwise delivery (Env3).

Detection means 22 connected to general control means 24 (e.g. a microprocessor and memories) are provided at the inlet of the device to determine the position of the envelope delivered by the printer. The detection means advantageously comprise at least one envelope-edge detector. The detector for determining said position may be associated with means for delivering the format and the orientation of the envelope at the outlet of the general-purpose printer (after this data has been entered into a memory of the microprocessor by the operator, the orientation in principle being fixed for any given type of printer). Knowledge of the format makes it possible to control conveying of the envelope by the first propulsion assembly 14, and knowledge of the orientation makes it possible to control rotation of the envelope for the purposes of reorienting it.

The second stationary plate 12 is provided with a central opening for receiving a turntable 26 making it possible to displace the envelope, within a plane, from a first position corresponding to its position at the outlet of the printer to a second position making it possible for documents to be inserted into the envelope. It should be noted that, to insert the documents, it is necessary for the envelope always to be placed widthwise after said displacement. The turntable 26 is rotated by first drive means 28 actuated by the control means 24 as a function of the state of the detection means 22. The turntable may also be displaced vertically against a counter-turntable 30 mounted to rotate in the first fixed plate 10 to enable the envelope to be held stationary by being clamped so that it can be rotated. The turntable is raised via a first cam 33 by means of second drive means 32 at the same time as the carriage 20 carrying the propulsion assemblies 14, 16, 18 is lowered by means of a second cam 34*a*, 34*b*. The action of the first cam 33 on the turntable 26 takes place via a pivotally mounted lever 35 provided with an elongate opening 350 through which a central pin 260 of the turntable can slide. Under the action of the rotation of the first cam 33, the lever is pivoted (and the turntable is thus displaced) against first spring means 262 connected between the turntable and a stationary portion of the device, e.g. the second stationary plate 12. The second cam 34*a*, 34*b* acts on the carriage 20 against second spring means 200 connected between the carriage and a stationary portion of the device, via a cam abutment 202*a*, 202*b* secured to the carriage.

The propulsion assemblies extend over substantially the entire width of the first and second plates 10, 12, and they are disposed on either side of the assembly formed by the motor-driven turntable and by the counter-turntable, and constituting means for reorienting envelopes in a plane parallel to the displacement direction D. Preferably, the common shafts 108, 208, 308 of the propulsion assemblies are controlled by common third drive means 36 of the stepper motor type, e.g. via sprockets 38, 40, 42, 44, 46 and an endless belt 48.

The envelope-feed device of the invention operates as follows. The envelope delivered by the printer is inserted via the inlet of the device into the chute 8 where it is engaged by the first propulsion assembly 12 actuated by the third drive means 36. The envelope is then conveyed along the conveyor path to the turntable 26. With the third drive means being OFF (the ON-time of the third drive means depending on the format of the envelope), the second drive means 32 are actuated to raise the turntable and to press the envelope against the counter-turntable 30. Simultaneously, the carriage 20 supporting the propulsion assemblies 14, 16, 18 is lowered. Once the turntable has been raised, the first drive means 28 are then actuated to rotate the resulting turntable/envelope/counter-turntable assembly. The direction of rotation depends closely on the orientation of the envelope at the outlet of the printer (including the position of the flap), as shown in the following table:

| Envelope position | Angle of rotation |
|---|---|
| Widthwise<br>Flap on leading edge | 0° |
| Widthwise<br>Flap on trailing edge | 180° (or −180°) |
| Lengthwise<br>Flap on right | 270° (or −90°) |
| Lengthwise<br>Flap on left | 90° |

Once the envelope has been rotated, the first drive means are stopped, and the second drive means are actuated again to lower the turntable and simultaneously to raise the propulsion assemblies. The envelope can then be conveyed to the outlet of the device, by means of the second and third propulsion assemblies 16, 18, where it is presented in an optimum position for document insertion purposes.

Naturally, the invention is not limited to the above-described preferred embodiment, but rather it also relates to variants lying within the understanding of the person skilled in the art. For example, it is possible to provide a suction device for holding the envelope firmly on the turntable instead of the counter-turntable together with the drive means for vertically displacing the turntable. Similarly, a detector for detecting when an edge of an envelope goes past suffices to determine the position of the envelope at the outlet of the printer when a computer connected to the printer is capable of recognizing the printer and of being informed in advance of the format and orientation characteristics of the envelopes used.

What is claimed is:

1. A feed device for feeding envelopes delivered by a general-purpose printer to a machine in a predetermined orientation along a conveyance path, said envelopes being delivered by said printer in at least two alternative positions including a first position in which said envelope is completely off-set from a longitudinal center line of said conveyance path, and a second position different from said first position, said feed device comprising:

detection means for detecting the position of the envelope at the outlet of the printer; and reorientation means for reorienting the envelope as a function of its position as determined by said detection means by rotating said envelope over different angles depending on whether said envelope is in said first or second position.

2. A feed device according to claim 1, wherein said detection means comprise a detector for detecting an edge of the envelope.

3. A feed device according to claim 2, wherein said detection means further comprise processing means for storing information concerning the envelope.

4. A feed device according to claim 1, wherein said reorientation means comprise a turntable which, by rotating within a plane, makes it possible to displace the envelope from a first position corresponding to its position at the outlet of the printer to a second position enabling documents to be inserted into it.

5. A feed device according to claim 4, wherein the turntable is rotated by first drive means under the action of control means.

6. A feed device according to claim 4, wherein said reorientation means further comprise an opposite turntable against which the turntable can be displaced by means of second drive means, so as to hold the envelope stationary by clamping it so that it can be rotated.

7. A feed device according to claim 1, further comprising first propulsion means for propelling the envelope from an inlet of the device to the reorientation means, and second propulsion means for propelling the reoriented envelope to an outlet of the device.

8. A feed device according to claim 7, wherein said propulsion means are actuated as a function of the position of the envelope as determined by said detection means.

9. A feed device according to claim 8, wherein said detection means further comprises processing means for storing information concerning the envelope.

10. A feed device according to claim 7, wherein the first and second propulsion means comprise at least two parallel assemblies of propulsion rollers controlled by third drive means common to the two propulsion means and acting against associated counter-rollers.

11. A feed device according to claim 10, wherein there are at least two of said propulsion rollers, which are spaced apart to convey the envelope in the device.

12. A document folding and/or inserting machine equipped with a feed device according to claim 1.

* * * * *